US007003826B1

(12) United States Patent
Kinsman

(10) Patent No.: US 7,003,826 B1
(45) Date of Patent: Feb. 28, 2006

(54) SHEET SET FOR BUNK BEDS

(76) Inventor: Dawn Kinsman, 509 Yucca Dr., Pierre, SD (US) 57501

( * ) Notice: Subject to any disclaimer, the term of this patent is extended or adjusted under 35 U.S.C. 154(b) by 0 days.

(21) Appl. No.: 10/958,323

(22) Filed: Oct. 5, 2004

(51) Int. Cl.
*A47G 9/04* (2006.01)
*A47G 9/02* (2006.01)

(52) U.S. Cl. ..... 5/497; 5/482

(58) Field of Classification Search ..... 5/497, 5/495, 496, 498, 482, 499, 923
See application file for complete search history.

(56) References Cited

U.S. PATENT DOCUMENTS 2,662,234 A * 12/1953 Citron ..... 5/497
3,143,747 A 8/1964 McSorley et al.
3,965,504 A 6/1976 Ainsworth
4,964,184 A * 10/1990 Lewis ..... 5/496
4,979,251 A 12/1990 Lazar
5,070,561 A 12/1991 Keidser
5,092,010 A 3/1992 Wong
5,327,595 A 7/1994 Allen
5,465,440 A * 11/1995 Heptner ..... 5/497
5,557,814 A * 9/1996 Cybulski ..... 5/496
6,557,194 B1 5/2003 Jeffries et al.

* cited by examiner

*Primary Examiner*—Alexander Grosz
(74) *Attorney, Agent, or Firm*—Jeffrey A. Proehl; Woods Fuller Shultz & SmithP.C.

(57) ABSTRACT

A sheet set is disclosed that facilitates mounting on a mattress of a bunk bed. The sheet set comprises a base sheet for mounting on the mattress, and includes a base panel with a top portion, a pair of opposite side portions and a pair of opposite end portions. A cover sheet mounts on the base sheet when the base sheet is mounted on the mattress to cover the base sheet, and has a closed side and an open side located opposite of the closed side. The cover sheet has a closed end and an open end located opposite of the closed end, with the closed end and the closed side being located adjacent to each other to form a pocket for receiving the corner portion of the mattress. Optionally, the cover sheet includes a flap that extends adjacent to the open side of the cover sheet for being folded back onto a top portion of the cover sheet.

12 Claims, 5 Drawing Sheets

SHEET SET FOR BUNK BEDS

BACKGROUND OF THE INVENTION

1. Field of the Invention

The present invention relates to bed sheets and more particularly pertains to a new sheet set for bunk beds that facilitates the making of the bunk bed from one side of the bunk bed.

2. Description of the Prior Art

The installation of sheets on the mattress of a bed, and especially the making of the bed after the sheets have been installed, is a chore. This task is especially challenging when the bed to be made is bunked, or raised up, above another bed. Such bed structures, often referred to as "bunk beds", are also often positioned against a wall, and sometimes in a corner, of a room, which can significantly reduce the access to some portions of the bed and thus make the task even more difficult. Another To further complicate matters, the mattress is often partially positioned in a cavity with sides that hold the mattress in place, which makes "tucking" a portion of the sheets below the mattress difficult.

Many different sheets structures have been proposed for keeping a fitted sheet on a mattress, and for keeping a top, "flat" sheet on the fitted sheet, but these sheets, while possibly being effective for keeping the sheets together on the mattress, do not facilitate the making of the top sheet of the bed in between uses of the bed.

SUMMARY OF THE INVENTION

In view of the foregoing disadvantages inherent in the known types of bed sheets now present in the prior art, the present invention provides a new sheet set for bunk beds that facilitates the making of the bunk bed from one side of the bunk bed in between uses of the bed.

To attain this, the present invention generally comprises a sheet set that facilitates mounting on a mattress of a bunk bed. The sheet set comprises a base sheet for mounting on the mattress, and includes a base panel with a top portion, a pair of opposite side portions and a pair of opposite end portions. A cover sheet mounts on the base sheet when the base sheet is mounted on the mattress to cover the base sheet, and has a closed side and an open side located opposite of the closed side. The cover sheet has a closed end and an open end located opposite of the closed end, with the closed end and the closed side being located adjacent to each other to form a pocket for receiving the corner portion of the mattress. Optionally, the cover sheet includes a flap that extends adjacent to the open side of the cover sheet for being folded back onto a top portion of the cover sheet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
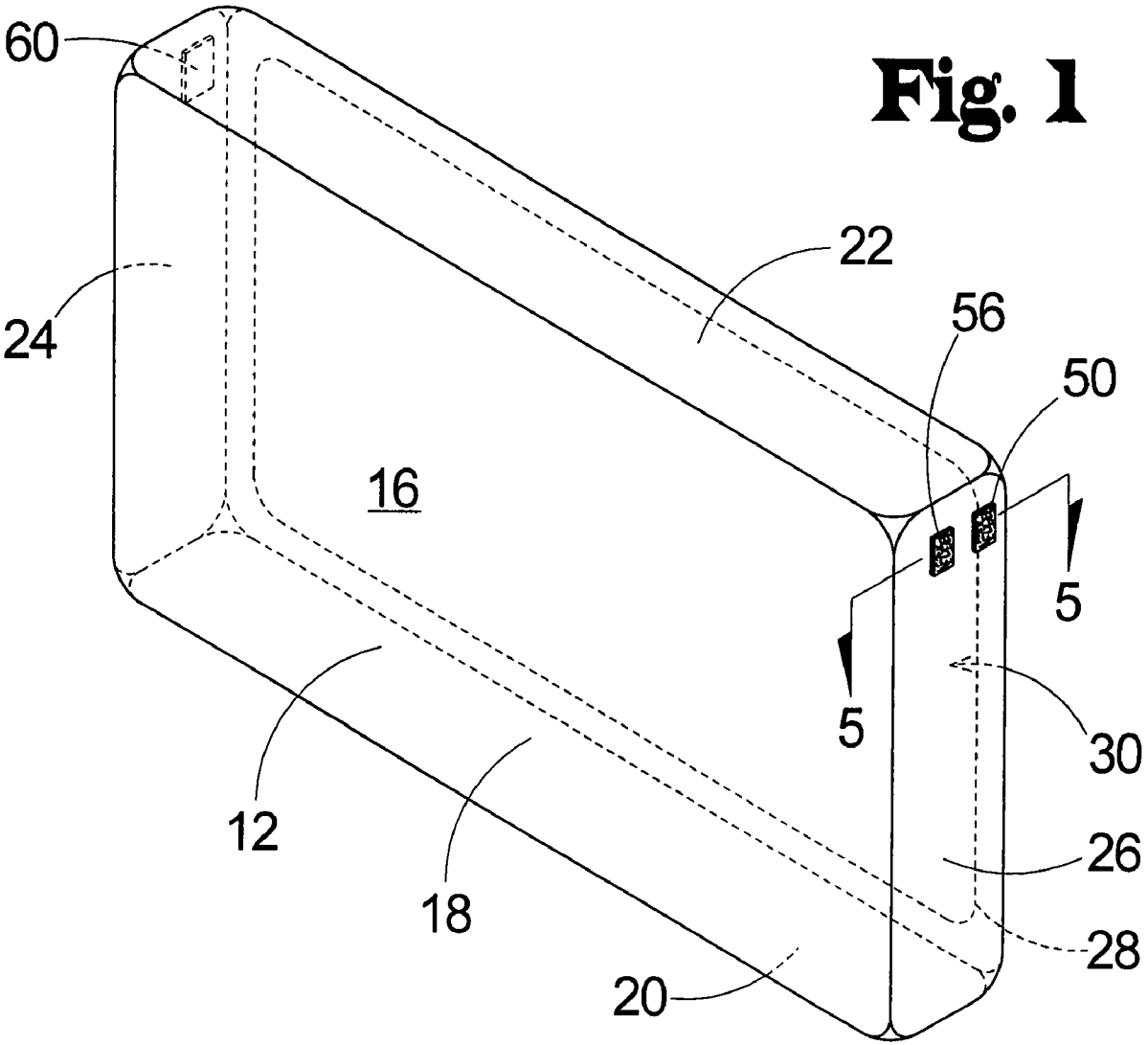
FIG. 1 is a schematic perspective view of a base sheet of the sheet set of the present invention.
Figure 2:
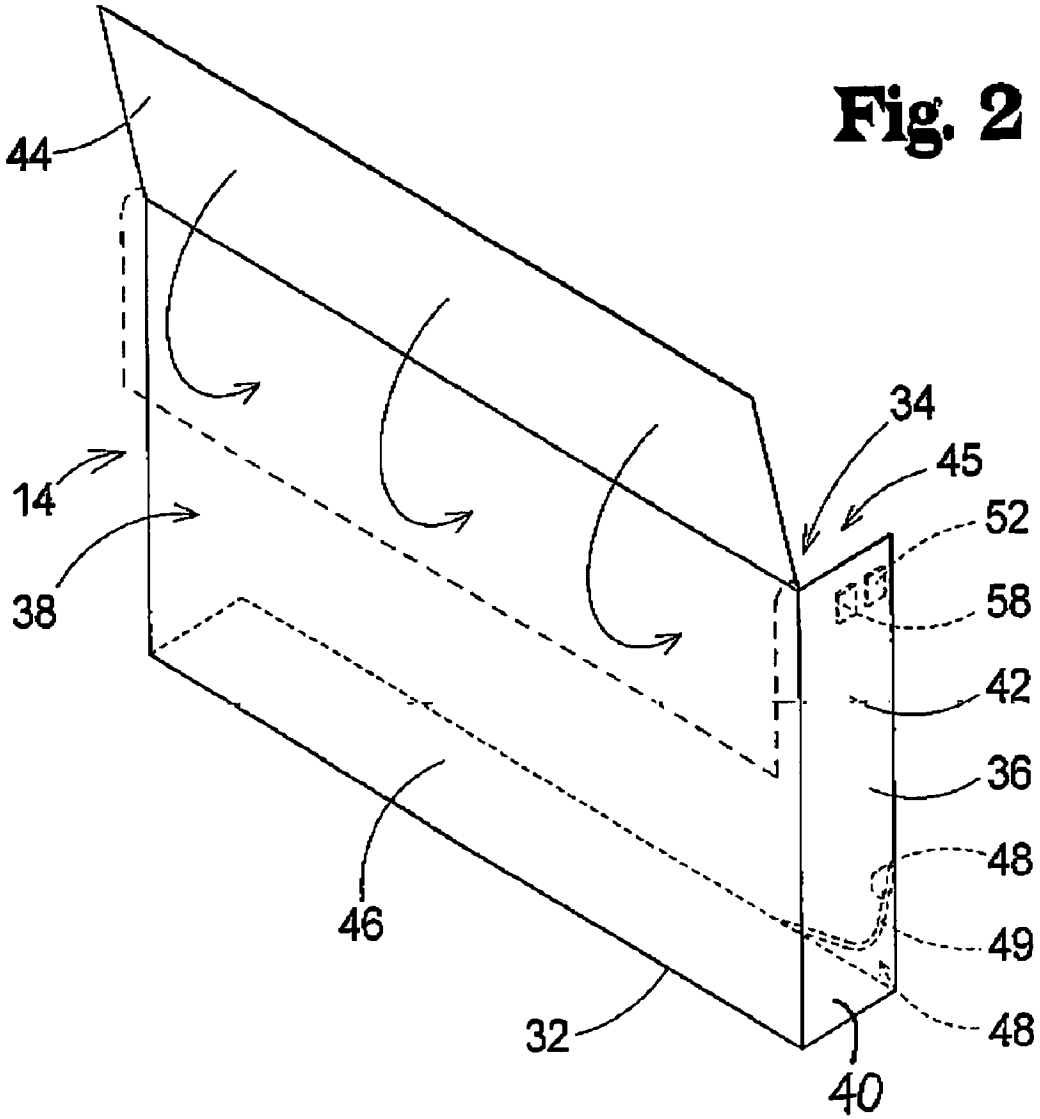
FIG. 2 is a schematic perspective view of a cover sheet of the sheet set of the present invention, showing the flap in an extended position and in a covering position (in broken lines).
Figure 3:
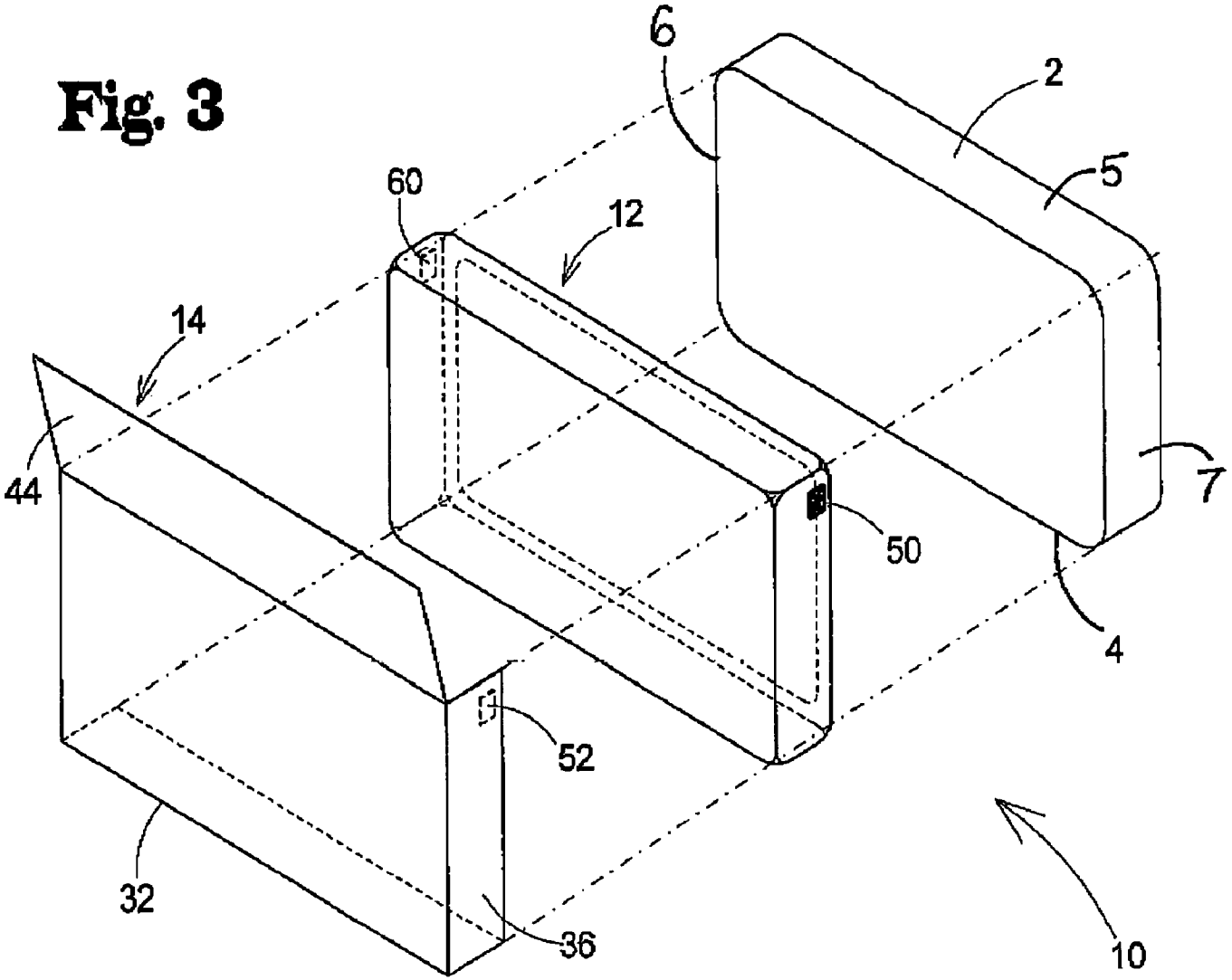
FIG. 3 is a schematic perspective exploded view of the base sheet and cover sheet of the present invention with respect to a mattress.
Figure 4:
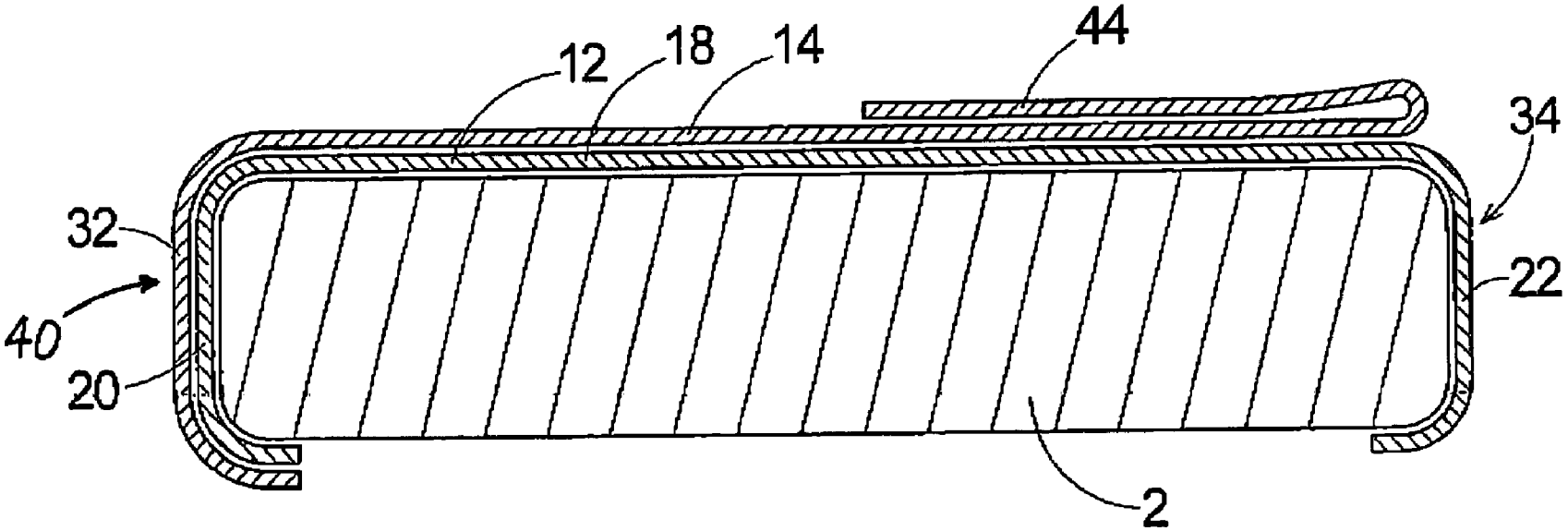
FIG. 4 is a schematic sectional view of the base sheet and cover sheet of the present invention mounted on a mattress.
Figure 5:
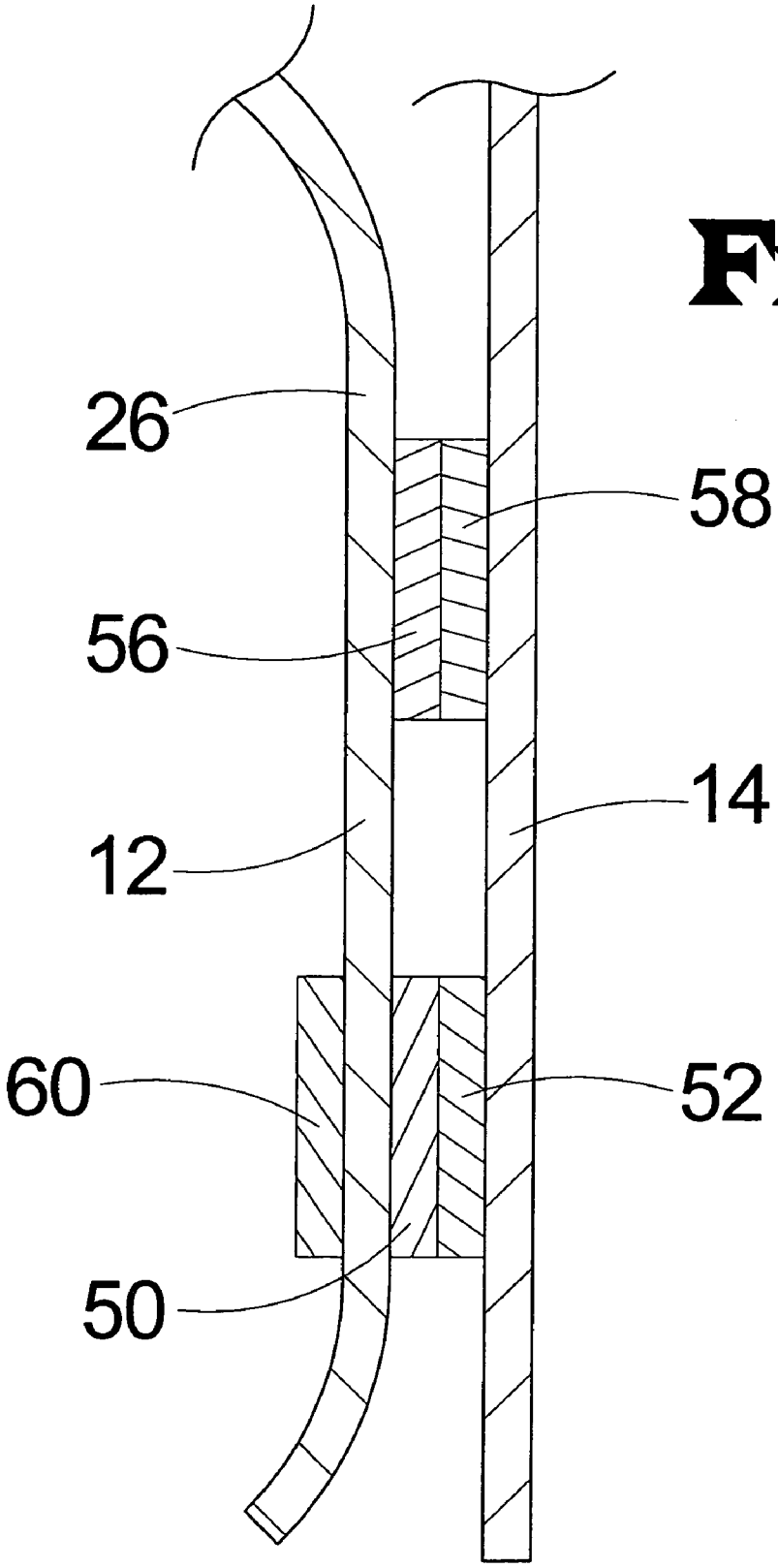
FIG. 5 is a schematic sectional view of a portion of the base sheet and the cover sheet of the present invention.

With reference now to the drawings, and in particular to FIGS. 1 through 5 thereof, a new sheet set for bunk beds that embodies the principles and concepts of the present invention and is generally designated by the reference numeral 10 will be described.

The invention contemplates a sheet set that facilitates its mounting on a mattress 2 with opposite sides 4, 5 that are generally longer than opposite ends 6, 7 of the mattress 2. The mattress 2 is suitably of the type that is situated on a bunk-type bed, in which portions of the upper bunk are difficult to reach so that making up the bed on a daily basis can be a difficult chore.

The sheet set of the invention generally comprises a base sheet 12 for mounting on the mattress. The sheet set also includes a cover sheet 14 for mounting on the base sheet 12 when the base sheet 12 is mounted on the mattress 2. The cover sheet 14 thus covers at least a portion of the base sheet 12 when the cover sheet 14 is mounted on the base sheet 12.

The base sheet 12 generally comprises a base panel 16, which may be formed of a single piece of material but may also be formed by more than one piece of material sewn or otherwise joined together. The base sheet 12 has a top portion 18, a pair of opposite side portions 20, 22, and a pair of opposite end portions 24, 26. The side portions 20, 22 and the end portions 24, 26 generally correspond to the sides 4, 5 and ends 6, 7 of the mattress 2. The pair of opposite side portions 20, 22 and the pair of end portions 24, 26 each have a length that extends substantially parallel to the top portion 18, the lengths of the side portions 20, 22 are greater or longer than the lengths of the end portions 24, 26.

The base sheet 12 has a perimeter 28 forming an opening 30 for receiving the mattress 2. The base sheet 12 may also include constricting means that is positioned along at least a portion of the perimeter 28 for constricting the size of the opening 30 unless force is applied to the perimeter 28 to expend the opening 30. In the illustrative embodiment of the invention, the constricting means comprises an elastic material attached to the perimeter 28. The constricting means tends to gather the portion of the base sheet 12 that is adjacent to the perimeter 28 and pull a portion of the base sheet 12 below the bottom of the mattress 2 to retain the base sheet 12 on the mattress.

The cover sheet 14 of the invention has a closed side 32 and an open side 34 that is located generally opposite of the closed side 32. The closed portion 4 of the mattress 2, while the open side 34 exposes one of the side portions 22 of the base sheet 12. The cover sheet 14 also may have a closed end 36 and an open end 38. Preferably, the closed end 36 and the closed side 32 are located adjacent to each other to form a pocket 40 for receiving the corner portion of the mattress 2. The open end 38 is also preferably located adjacent to the open side 34.

Significantly, the cover sheet 14 includes a flap 44 extending adjacent to the open side 34. The flap 44 is capable of being folded back onto a top portion 46 of the cover sheet 14 when the cover sheet is mounted on the base sheet 12. In one illustrative embodiment of the invention, the flap 44 is capable of covering approximately one half of the top portion 46 of the cover sheet 14, although greater or lesser amounts may be employed. In at least one embodiment of the invention, the flap 44 is located adjacent to a notch 45, or absence of, or discontinuity in, the material of the cover sheet 14, located between the end portion 42 of the cover sheet 14 and the open side 34 of the cover sheet below the flap 44. The notch 45 thus permits substantially free movement of the flap 44 without restriction from being connected to the end portion 42 of the cover sheet 14.

The cover sheet 14 may also include constricting means that are positioned along an edge 48 of the cover sheet 14, and preferably the constricting means are located adjacent to the pocket 40 of the cover sheet 14. In the illustrative embodiment of the invention, and similar to the base sheet 12, the constricting means for the cover sheet 14 comprises an elastic material attached to the edges 48. The constricting means, such as an elastic strip 49, tends to gather the portion of the cover sheet 14 that is adjacent to the edge 48 to further enhance the creation of the pocket 40 in the cover sheet 14 for receiving the corner portion 4 of the mattress 2 that is covered by the base sheet 12.

A significant aspect of the invention is the means employed to fasten the cover sheet to the base sheet, in addition to the pocket 40 formed in the cover sheet 14. Even more significant is the location of the fastening means on the base sheet 12 and the cover sheet 14 and how they cooperate together. The fastening means will be described herein as being patches or pieces of hook and loop fasteners, often available under the tradename VELCRO, but is should be understood that other cooperative fastening elements could be used, such as buttons/buttonholes and snaps, although for reasons of ease of use, washability, user comfort, etc., the use of the hook and loop fasteners is preferred. The hook and loop fasteners are mounted on the base sheet 12 and the cover sheet 14. A first component 50 of the hook and loop fasteners is positioned on one 26 of the end portions of the base sheet 12 adjacent to one 22 of the side portions. A second, cooperative component 52 of the hook and loop fasteners is positioned on the cover sheet 14 in a location adjacent to the open side 34 of the cover sheet 14. The second component 52 of the hook and loop fasteners is located on an end portion 42 of the cover sheet 14 is a position that corresponds to the position of the first fastener component 50 on the base sheet 12 when the base sheet 12 and cover sheet 14 are installed on a mattress 2 so that these elements can connect together. The connection of the first fastener component 50 to the second fastener component 52 thus functions to hold the corner portion 4 of the mattress 2 in the pocket 40, especially in the absence of a panel in the cover sheet 14 over the open side 34, which would otherwise serve to help hold the mattress 2 in the pocket 40, and thus the flap 44 is not constrained and is free to be moved back over other portions of the cover sheet 14.

Optionally, additional hook and loop fastener elements may be mounted on the base 12 and cover 14 sheets of the invention to provide enhanced versatility and enhanced fastening ability. An additional fastener component 56 may be positioned on the base sheet 12, and an additional fastener component 58 may be complimentarily positioned on the cover sheet 14, in locations adjacent to the fastener components 50, 52 on the respect sheets 12, 14 to provide additional holding capability. As a further option, fastening components 60 may be provided on opposite sides of the base 12 and cover 14 sheets so that the sheets may be turned inside out and still retain the fastening function provided by the fastening components.

In the illustrative embodiment of the invention, the hook and loop fastener components have a size that is approximately 1 inch by 2 inches, although the size may be increased to approximately 2 inches by 2 inches.

As a further option, a color or style coordinated comforter (not shown) may be used with the sheet set of the invention to provide a more pleasing visual presentation.

In use, the base sheet 12 is placed over the mattress 2 so that the portions along the perimeter edge 28 of the base sheet 12 is positioned, or tucked, under the mattress 2. The cover sheet 14 is then laid over the base sheet 12 and the mattress so that the orientation of the cover sheet 14 generally corresponds to the base sheets 12 and the mattress 2. The corner portion 4 of the mattress 2 is inserted or guided into the pocket 40 that is formed by the closed side 32 and the closed end 36 of the cover sheet 14. Once the corner portion 4 of the mattress 2 is positioned in the pocket 40, the closed end 26 portion of the cover sheet 14 may be stretched along the end portion 26 of the base sheet 12, and the first fastener component 50 on the base sheet 12 is mated with the second fastener component 52 of the cover sheet 14. The connection of the fastener components 50, 52 thus functions in part to hold the corner portion 4 of the mattress 2 in the pocket 40. The closed side 32 of the cover sheet 14 may then be positioned along the side of the mattress 2, so that the bulk of the cover sheet 14 extends over the top of the mattress. The flap 44 on the cover sheet 14 may be initially extended along the side of the mattress 2 while the rest of the cover sheet 14 is situated with respect to the base sheet 12 and the mattress 2. It will be recognized that, even if the mattress 2 is partially situated in a depression or box of a bunk frame that extends partially up the sides of the mattress, the notch 45 in the cover sheet permits the flap 44 to free extend over the side of the bunk frame without being constrained by the closed end of the cover sheet 14. The flap 44 may then be folded back upon the top region of the cover sheet 14 so that the flap 44 does not extend over or adjacent to the side portion 22 of the base sheet 12, or the side of the mattress 2.

The flap feature of the invention permits the neat and orderly positioning of the flap 44 on the bunk bed without having to tuck the flap 44 under the mattress to obtain a neat appearance, since the flap 44 is not required to hang over the side of the mattress. The user of the bed is thus not required to "untuck" the flap 44 to enter the made bed, while the user still has the luxury of a significant amount of material forming the flap 44 to cover himself or herself when the bed is being used, so the user is not restricted to use only a small portion of the cover sheet 14 because it was desired to reduce the amount of overhang of the cover sheet over the side of the bunk bed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sheet set that facilitates mounting on a mattress of a bunk bed, the sheet set comprising:

a base sheet for mounting on the mattress, the base sheet comprising a base panel with a top portion, a pair of opposite side portions, and a pair of opposite end portions; and a cover sheet for mounting on the base sheet when the base sheet is mounted on the mattress to cover the base sheet, the cover sheet having a closed side and an open side located opposite of the closed side, the cover sheet having a closed end and an open end located opposite of the closed end, the closed end and the closed side being located adjacent to each other to form a pocket for receiving the corner portion of the mattress.

2. The sheet set of claim 1 wherein the cover sheet includes a flap extending adjacent to the open side of the cover sheet, the flap being capable of being folded back onto a top portion of the cover sheet when the cover sheet is mounted on the base sheet.

3. The sheet set of claim 2 wherein the flap is capable of covering approximately one half of the top portion of the cover sheet.

4. The sheet set of claim 1 wherein the open side of the cover sheet exposes one of the side portions of the base sheet when the base sheet and the cover sheet are mounted on the mattress.

5. The sheet set of claim 1 wherein the open end of the cover sheet is located adjacent to the open side of the cover sheet.

6. The sheet set of claim 1 additionally comprising fastening means for removably fastening the cover sheet to the base sheet.

7. The sheet set of claim 6 wherein the fastening means is mounted on the base sheet and the cover sheet, a first component of the fastening means being positioned on one of the end portions of the base sheet adjacent to one of the side portions, and a second component of the fastening means being positioned on the cover sheet adjacent to the open side of the cover sheet, the first and second components of the fastening means being removably fastenable together when the base sheet and the cover sheet are mounted on the mattress.

8. The sheet set of claim 7 wherein the second component of the fastening means is located on an end portion of the cover sheet.

9. The sheet set of claim 1 wherein the cover sheet includes constricting means positioned along an edge of the cover sheet.

10. The sheet set of claim 9 wherein the constricting means are located adjacent to the pocket of the cover sheet.

11. The sheet set of claim 1 wherein the pair of side portions and the pair of end portions of the base sheet each have a length extending substantially parallel to the top portion, the lengths of the side portions being greater than the lengths of the end portions.

12. The sheet set of claim 2 wherein the cover sheet includes a notch formed therein for permitting free movement of the flap with respect to an end portion of the cover sheet.

* * * * *